US007527904B2

(12) United States Patent
Wu et al.

(10) Patent No.: US 7,527,904 B2
(45) Date of Patent: May 5, 2009

(54) IMAGING MEMBER

(75) Inventors: Jin Wu, Webster, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 524 days.

(21) Appl. No.: 11/311,788

(22) Filed: Dec. 19, 2005

(65) Prior Publication Data

US 2007/0141490 A1 Jun. 21, 2007

(51) Int. Cl.
*G03G 15/02* (2006.01)

(52) U.S. Cl. ..... 430/59.1; 430/78; 399/159

(58) Field of Classification Search ..... 430/59.1, 430/78; 399/159
See application file for complete search history.

(56) References Cited

U.S. PATENT DOCUMENTS

| | | | | |
|---|---|---|---|---|
| 3,121,006 | A | 2/1964 | Middleton et al. | |
| 3,357,989 | A | 12/1967 | Byrne et al. | |
| 3,442,781 | A | 5/1969 | Weinberger | |
| 4,232,102 | A | 11/1980 | Horgan et al. | |
| 4,233,383 | A | 11/1980 | Horgan | |
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,298,697 | A | 11/1981 | Baczek et al. | |
| 4,299,897 | A | 11/1981 | Stolka et al. | |
| 4,306,008 | A | 12/1981 | Pai et al. | |
| 4,338,387 | A | 7/1982 | Hewitt | |
| 4,338,390 | A | 7/1982 | Lu | |
| 4,415,639 | A | 11/1983 | Horgan | |
| 4,439,507 | A | 3/1984 | Pan et al. | |
| 4,471,041 | A | 9/1984 | Baranyi et al. | |
| 4,489,143 | A | 12/1984 | Gilbert et al. | |
| 4,507,480 | A | 3/1985 | Horgan et al. | |
| 4,560,635 | A | 12/1985 | Hoffend et al. | |
| 4,619,879 | A * | 10/1986 | Kakuta et al. | 430/58.15 |
| 4,988,597 | A | 1/1991 | Spiewak et al. | |
| 5,134,048 | A * | 7/1992 | Terrell et al. | 430/59.4 |
| 5,213,929 | A * | 5/1993 | Takano et al. | 430/78 |
| 5,244,762 | A | 9/1993 | Spiewak et al. | |
| 5,821,021 | A * | 10/1998 | Kawahara | 430/78 |
| 6,232,025 | B1 * | 5/2001 | Srinivasan | 430/58.4 |
| 2004/0048181 | A1 * | 3/2004 | Tanaka | 430/78 |

FOREIGN PATENT DOCUMENTS

| | | | |
|---|---|---|---|
| EP | 1255167 | A2 | 11/2002 |
| EP | 1308481 | A | 5/2003 |
| EP | 1536292 | A | 6/2005 |
| FR | 2182125 | A1 | 12/1973 |
| JP | 62061981 | A | 3/1987 |
| JP | 63106662 | A | 5/1988 |
| JP | 63222172 | A | 9/1988 |

OTHER PUBLICATIONS

EP Search Report dated Mar. 21, 2007.

* cited by examiner

*Primary Examiner*—Mark A Chapman
(74) *Attorney, Agent, or Firm*—Eugene O. Palazzo; Fay Sharpe LLP

(57) ABSTRACT

An imaging device including a substrate, a charge generating layer, and a charge transport layer is disclosed. A particular charge generating layer is disclosed that includes porphine, or its derivatives, to facilitate charge generation while suppressing ghosting and improving photoreceptor performance.

13 Claims, 1 Drawing Sheet

IMAGING MEMBER

BACKGROUND

The present disclosure relates, in various exemplary embodiments, to layered photoresponsive devices, imaging apparatuses and processes thereof. More specifically, the exemplary embodiments relate to improved layered photoresponsive devices comprised generally of a charge transport layer and a photogenerating layer. The photogenerating layer contains porphine or its derivatives to reduce ghosting or other related print defects.

The layered photoresponsive devices of the exemplary embodiments are useful as imaging members in various electrostatographic imaging systems, including those systems wherein electrostatic latent images are formed on the imaging member. For example, imaging members can be used in electrophotographic, electrostatographic, xerographic and like devices, including printers, copiers, scanners, facsimiles, and including digital, image-on-image, and like devices. More particularly, the embodiments pertain to a photoreceptor that incorporates specific molecules to facilitate charge generation while suppressing ghosting and improving photoreceptor performance.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles (such as toner particles) on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

"Ghosting" is a typical printing defect. Ghosting is thought to result from the accumulation of charge somewhere in the photoreceptor. Consequently, when a sequential image is printed, the accumulated charge results in image density changes in the current printed image that reveals the previously printed image.

Ghosting patterns form either lighter images than the background or darker images than the background. In instances where the ghost image is lighter than the background, this phenomena is known as "negative ghosting" and where the ghost image is darker than the background, this phenomenon is known as "positive ghosting." Because the ghosting phenomenon is complex and results from actual electrostatic printer or copy machine system characteristics, toner flowability, toner triboelectric charge properties, and even exponential memory decay time of the photoconductor, the underlying cause is still not entirely understood.

Ghosting can occur in a photoreceptor when a residual image remains in the photoreceptor, and specifically within the charge generating layer. Ghosting, in certain instances and if attributable to the photoreceptor or imaging member, can be remedied by ensuring more thorough erasure, such as by greater exposure to light of a suitable wavelength. Although satisfactory in certain applications, a need remains for another strategy to reduce the potential for ghosting in a photoreceptor or other like imaging member.

INCORPORATION BY REFERENCE

U.S. Pat. Nos. 4,338,387; 4,286,033; 4,291,110; 5,244,762; 4,988,597; 3,121,006; 3,357,989; 3,442,781; 4,265,990; 4,233,384; 4,471,041; 4,489,143; 4,507,480; 4,306,008; 4,299,897; 4,232,102; 4,233,383; 4,415,639; and 4,439,507 are each incorporated herein by reference in their entirety.

BRIEF DESCRIPTION

The present disclosure relates, in various exemplary embodiments, to a photoreceptor having a charge generating layer containing a porphine or a porphine derivative. The porphine or its derivatives are incorporated into the charge generating layer to suppress ghosting and improve photoreceptor performance.

In another exemplary embodiment, the disclosure is directed to a photoreceptor having a charge generating layer comprising a photogenerating pigment, a binder and a porphine, or a derivative thereof, additive. The additive is generally mixed or dispersed into the charge generating system. In a further exemplary embodiment, the photogenerating pigment is a phthalocyanine, and the binder is any suitable polymeric film forming binder material to form a binder matrix. In a still further exemplary embodiment, the porphine additive comprises a fundamental skeleton of four pyrrole nuclei united through the α-positions by four methine groups to form a macrocylic structure as shown below:

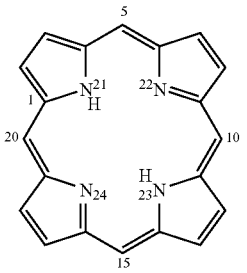

A further exemplary embodiment provides an imaging member comprising a substrate, a charge generating layer-disposed on the substrate, and a charge transport layer disposed on the charge generating layer. The charge generating layer comprises a porphine agent selected from the group consisting of (1) 21H; 23H-Porphine; (2) meso-Tetraphenylporphine-4,4',4",4'"-tetracarboxylic acid; (3) Phytochlorin; (4) 5,10,15,20-Tetraphenyl-21H, 23H-porphine; (5) 5,10, 15,20-Tetra(4-pyridyl)-21H,23H-porphine; (6) 5, 10, 15, 20-Tetrakis(3-hydroxyphenyl)-21H, 23H-porphine; (7) 5,10, 15,20-Tetrakis(o-dichlorophenyl)-21H,23H-porphine; (8) 5,10,15,20-Tetrakis(4-trimethylammoniophenyl) porphine tetrachloride; (9) meso-Tetraphenylporphine-4,4',4",4" tetracarboxylic acid, copper(II); (10) 5,10,15,20-Tetrakis(4-sulfonatophenyl)-21H,23H-porphine copper(II); (11)-5,10,15, 20-Tetrakis(pentafluorophenyl)-21H,23H-porphine palladium(II); (12) 2,3,7,8,12,13,17,18-Octaethyl-21H, 23H-porphine vanadium (IV) oxide; (13) 3,8,13,18-Tetramethyl-21H,23H-porphine-2,7,12,17-tetrapropionic acid dihydrochloride; (14) 8,13-Divinyl-3,7,12,17-tetramethyl-21H, 23H-porphine-2,18-dipropionic acid cobalt(III) chloride; (15) 8,13-Bis(ethyl)-3,7,12,17-tetramethyl-21H,23H-porphine-2,18-dipropionic acid chromium(III) chloride; (16) 3,7,12,17-Tetramethyl-21H,23H-porphine-2,18-dipropionic acid dihydrochloride; (17) meso-Tetraphenylporphine-4,4', 4",4'"-tetracarboxylic acid, iron (III) chloride; (18) 8,13-Bis (1-hydroxyethyl)-3,7,12,17-tetramethyl-21H,23H-porphine-2,18-dipropionic acid; (19) 5,10,15,20-Tetrakis(4-sulfonatophenyl)-21H,23H-porphine, manganese (III) chloride; (20) Pyropheophorbide-α-methyl ester; (21) 5,10, 15,20-Tetraphenyl-21H,23H-porphine nickel(II); (22) N-Methyl Mesoporphyrin IX; (23) 8,13-Bis(vinyl)-3,7,12, 17-tetramethyl-21H,23H-porphine-2,18-dipropionic acid; (24) 29H,31H-tetrabenzo porphine; (25) Uroporphyrin I dihydrochloride; (26) 8,13-Bis(vinyl)-3,7,12,17-tetramethyl-21H,23H-porphine-2,18-dipropionic acid zinc(II); (27) 5,10,15,20-Tetrakis(1-methyl-4-pyridinio) porphine tetra(p-toluenesulfonate); (28) 8,13-Bis(ethyl)-3,7,12,17-tetramethyl-21H,23H-porphine-2,18-dipropionic acid tin(IV) dichloride; and the like and combinations thereof.

In another exemplary embodiment, a method for reducing the potential for ghosting in an imaging member is provided. The method comprises incorporating a porphine agent or additive into a charge generating layer of the imaging member, wherein the agent or additive is selected from the group consisting of (1) 21H;23H-Porphine; (2) meso-Tetraphenylporphine-4,4',4",4'"-tetracarboxylic acid; (3) Phytochlorin; (4) 5,10,15,20-Tetraphenyl-21H,23H-porphine; (5) 5,10, 15,20-Tetra(4-pyridyl)-21H,23H-porphine; (6) 5,10,15,20-Tetrakis(3-hydroxyphenyl)-21H,23H-porphine; (7) 5,10,15, 20-Tetrakis(o-dichlorophenyl)-21H,23H-porphine; (8) 5,10, 15,20-Tetrakis(4-trimethylammoniophenyl) porphine tetrachloride; (9) meso-Tetraphenylporphine-4,4',4",4" tetracarboxylic acid, copper(II); (10) 5,10,15,20-Tetrakis(4-sulfonatophenyl)-21H,23H-porphine copper(II); (11) 5,10,15, 20-Tetrakis(pentafluorophenyl)-21H,23H-porphine palladium(II); (12) 2,3,7,8,12,13,17,18-Octaethyl-21H,23H-porphine vanadium (IV) oxide; (13) 3,8,13,18-Tetramethyl-21H,23H-porphine-2,7,12,17-tetrapropionic acid dihydrochloride; (14) 8,13-Divinyl-3,7,12,17-tetramethyl-21H,23H-porphine-2,18-dipropionic acid cobalt(III) chloride; (15) 8,13-Bis(ethyl)-3,7,12,17-tetramethyl-21H,23H-porphine-2,18-dipropionic acid chromium(III) chloride; (16) 3,7,12, 17-Tetramethyl-21H,23H-porphine-2,18-dipropionic acid dihydrochloride; (17) meso-Tetraphenylporphine-4,4',4",4'"-tetracarboxylic acid, iron (III) chloride; (18) 8,13-Bis(1-hydroxyethyl)-3,7,12,17-tetramethyl-21H,23H-porphine-2,18-dipropionic acid; (19) 5,10,15,20-Tetrakis(4-sulfonatophenyl)-21H,23H-porphine, manganese (III) chloride; (20) Pyropheophorbide-α-methyl ester; (21) 5,10, 15,20-Tetraphenyl-21H,23H-porphine nickel(II); (22) N-Methyl Mesoporphyrin IX; (23) 8,13-Bis(vinyl)-3,7,12, 17-tetramethyl-21H,23H-porphine-2,18-dipropionic acid; (24) 29H,31H-tetrabenzo porphine; (25) Uroporphyrin I dihydrochloride; (26) 8,13-Bis(vinyl)-3,7,12,17-tetramethyl-21H,23H-porphine-2,18-dipropionic acid zinc(II); (27) 5,10,15,20-Tetrakis(1-methyl-4-pyridinio) porphine tetra(p-toluenesulfonate); (28) 8,13-Bis(ethyl)-3,7,12,17-tetramethyl-21H,23H-porphine-2,18-dipropionic acid tin(IV) dichloride; and the like and combinations thereof.

There is also provided an image forming apparatus for forming images on a recording medium comprising an electrophotographic imaging member having a charge retentive-surface to receive an electrostatic latent image thereon, wherein the electrophotographic imaging member comprises a charge generating layer having a porphine additive, a development component to apply a developer material to the charge-retentive surface to develop the electrostatic latent image to form a developed image on the charge-retentive surface, a transfer component for transferring the developed image from the charge-retentive surface to another member or a copy substrate, and a fusing member to fuse the developed image to the copy substrate.

These and other non-limiting features or characteristics of the embodiments of the disclosure are more particularly set forth below.

BRIEF DESCRIPTION OF THE DRAWINGS

The following is a brief description of the drawing, which is presented for the purposes of illustrating the exemplary embodiments set forth herein and not for the purposes of limiting the same.

DETAILED DESCRIPTION

Figure 1:
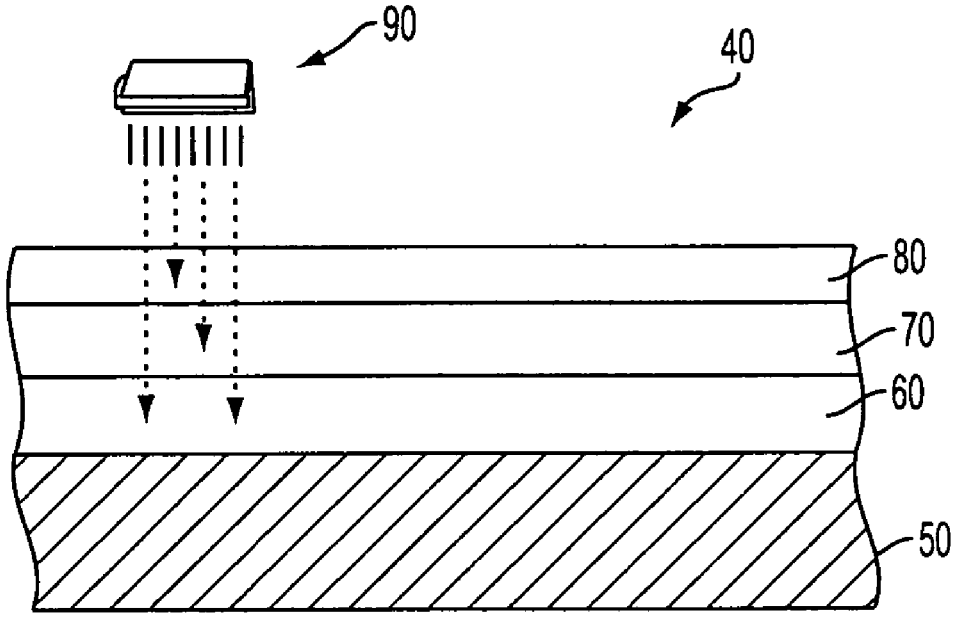
FIG. 1 illustrates a cross section of an exemplary layered imaging device of the exemplary embodiment.

The exemplary embodiments provide photoreceptors or imaging members having a photogenerating layer which incorporates a porphine additive in order to reduce, or substantially eliminate, printing defects in the print images, such as ghosting, that are present under certain conditions.

According to embodiments herein, an electrophotographic imaging member is provided, which generally comprises at least a substrate layer, a charge generating layer and, a charge transport layer. The imaging member can be employed in the imaging process of electrophotography, where the surface of an electrophotographic plate, drum, belt or the like (imaging member or photoreceptor) containing a photoconductive insulating layer on a conductive layer is first uniformly electro statically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Also included within the scope of the present disclosure are methods of imaging and printing with the photoresponsive devices described herein. These methods generally involve the formation of an electrostatic latent image on the imaging member, followed by developing the image with a toner composition comprised, for example, of thermoplastic resin, colorant, such as pigment, charge additive, and surface additives, referenced in U.S. Pat. Nos. 4,560,635; 4,298,697; and 4,338,390 for example, subsequently transferring the image to a suitable substrate, and permanently affixing the image thereto.

A more complete understanding of the processes and apparatuses disclosed herein can be obtained by reference to the accompanying drawings. These figures are merely a schematic representation based on convenience and the ease of demonstrating the present development, and is, therefore, not intended to indicate relative size and dimensions of an imaging device or components thereof.

FIG. 1 illustrates a cross section of an exemplary layered imaging device 40 of the exemplary embodiment including a substrate 50, a charge generating layer 60, a charge transport layer 70, and an optional overcoating layer 80. The device responds to as indicated in the above mentioned figure and as described herein when exposed to a suitable radiation source 90. In certain embodiments, an electrically conductive layer may be disposed on the substrate 50 and between the substrate 50 and the charge generating layer 60. Moreover, a blocking layer may also be present between the electrically conductive layer and the charge generating layer 60. One or more intermediate or adhesive layers may optionally be disposed between the blocking layer and the charge generating layer 60. All of these aspects are described in greater detail herein.

The exemplary embodiment is particularly desirable for electrophotographic imaging members which comprise two electrically operative layers, a charge generating layer and a charge transport layer. The exemplary embodiment imaging members exhibit reduced ghosting characteristics.

The Substrate

The substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically nonconducting materials, there may be employed various resins known for this purpose including polyesters, polycarbonates, polyamides, polyurethanes, and the like. The electrically insulating or conductive substrate may be flexible, semi-rigid, or rigid, and may have any number of different configurations such as, for example, a sheet, a scroll, an endless flexible belt, a cylinder, and the like. The substrate may be in the form of an endless flexible belt which comprises a commercially available biaxially oriented polyester known as MYLAR™, MELINEX™, and KALA-DEX® available from E.I. Du Pont de Nemours & Co.

The thickness of the substrate layer depends on numerous factors, including mechanical performance and economic considerations. The thickness of this layer may range from about 65 micrometers to about 150 micrometers, and particularly from about 75 micrometers to about 125 micrometers for optimum flexibility and minimum induced surface bending stress when cycled around small diameter rollers, for example, 19-millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

The Electrically Conductive Ground Plane

The substrate may include an electrically conductive ground plane. The electrically conductive ground plane may be an electrically conductive metal layer which may be formed, for example, on the coating article or substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electro-photoconductive member. Accordingly, for a flexible photoresponsive imaging device, the thickness of the conductive layer may be from about 20 Angstroms to about 750 Angstroms, and particularly from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength from about 4,000 Angstroms to about 9,000 Angstroms or a conductive carbon black dispersed in a plastic binder as an opaque conductive layer.

The Blocking Layer

After deposition of the electrically conductive ground plane layer, the blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photo-conductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxy-silylpropylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl)methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters, which modified polymers are then blended with other unmodified vinyl hydroxy ester and amide unmodified polymers. An example of such a blend is a 30-mole percent benzoate ester of poly(2-hydroxyethyl methacrylate) blended with the parent polymer poly (2-hydroxyethyl methacrylate). Still other suitable hole blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxy-ethyl methacrylate).

The blocking layer is continuous and may have a thickness of less than about 30 micrometers because greater thicknesses may lead to undesirably high residual voltage. A hole blocking layer of from about 0.005 micrometer to about 10 micrometers is preferred because charge neutralization after the exposure step is facilitated and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of from about 0.05:100 to about 5:100 is satisfactory for spray coating.

The Adhesive Layer

Intermediate layers between the blocking layer and the adjacent charge generating or photogenerating layer may be desired to promote adhesion. For example, the adhesive layer may be employed. If such layers are utilized, they preferably have a dry thickness of from about 0.001 micrometer to about 0.2 micrometer. Typical adhesive layers include film-forming polymers such as polyester, Du Pont 49,000 resin, available from E.I. Du Pont de Nemours & Co., VITEL-PE100™, available from Goodyear Rubber & Tire Co., polyvinylbutyral, polyvinylpyrrolidone, polyurethane, polymethyl methacrylate, and the like materials.

The Imaging Layer(s)

The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating layer overcoated with a charge transport layer. The photoconductive layers may contain homogeneous, heterogeneous, inorganic or organic compositions. One example of an electrophotographic imaging layer containing a heterogeneous composition is described in U.S. Pat. No. 3,121,006, wherein finely divided particles of a photoconductive inorganic compound are dispersed in an electrically insulating organic resin binder. Other well known electrophotographic imaging layers include amorphous selenium, halogen doped amorphous selenium, amorphous selenium alloys including selenium-arsenic, selenium-tellurium, selenium-arsenic-antimony, and halogen doped selenium alloys, cadmium sulfide and the like. Generally, these inorganic photoconductive materials are deposited as a relatively homogeneous layer.

Any suitable charge generating or photogenerating material may be employed as one of the two electrically operative layers in the multi-layer photoconductor version of the exemplary embodiment. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinac-ridones, substituted 2,4-diamino-triazines disclosed in U.S. Pat. No. 3,442,781, and polynuclear aromatic quinones available from Allied Chemical Corporation under the trade-name Indofast Double Scarlet, Indofast Violet Lake B, Indofast Brilliant Scarlet and Indofast Orange. Other examples of charge generating layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507.

A particular charge generating layer utilized in the photoreceptor embodiment comprises one or more porphine agents. A "porphine agent" as used herein refers to porphine or its derivatives. Porphine is also called porphyrin, comprising a fundamental skeleton of four pyrrole nuclei united through the α-positions by four methine groups to form a macrocyclic structure. Porphine or one or more of its derivatives are incorporated in a charge generating layer which comprises (i) one or more photogenerating pigments such as phthalocyanine, benzimidazole perylene (BZP), etc., (ii) one or more optional additives, and (iii) binder. The porphine agent can be physically mixed or otherwise dispersed into the charge generating dispersion.

As used herein, a porphine is any of several physiologically active nitrogenous compounds occurring widely in nature. The parent structure is comprised of four pyrrole rings, together with four nitrogen atoms and two replaceable hydrogens, for which various metal atoms can be readily substituted. A metal-free porphyrin molecule has the structure:

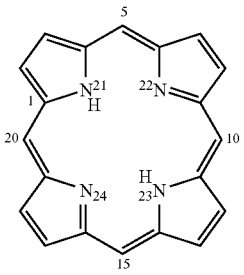

Specifically, examples of porphine and particular derivatives thereof for use in the exemplary embodiment layered imaging devices, and particularly for use in charge generating layers of such devices, are as follows:

(1)

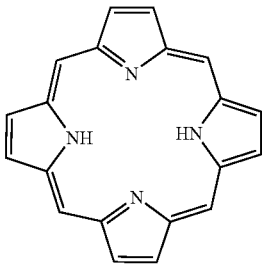

21H, 23H-Porphine (2)

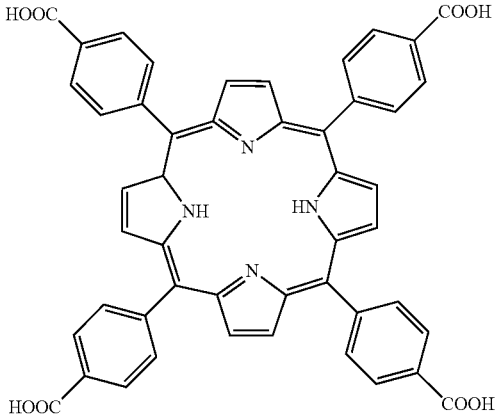

meso-Tetraphenylporphine-4, 4′, 4″, 4‴-tetracarboxylic acid

-continued (3)

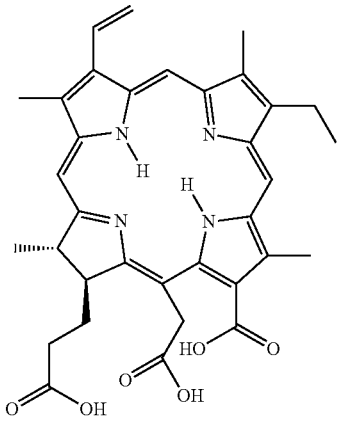

Phytochlorin (4)

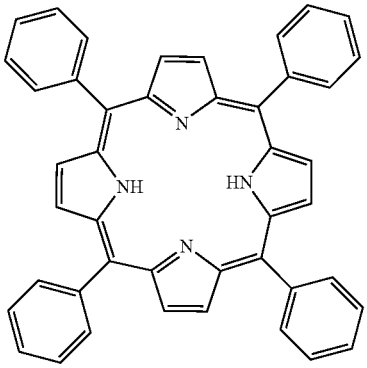

5, 10, 15, 20-Tetraphenyl
-21H, 23H-porphine (5)

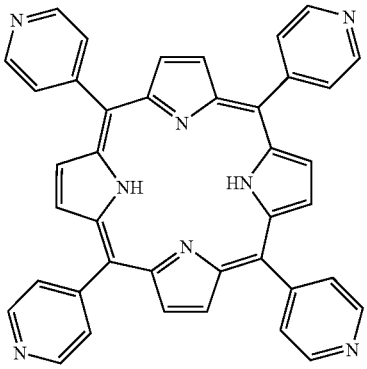

5, 10, 15, 20-Tetra(4-pyridyl)-21H, 23H-porphine

-continued
(6)
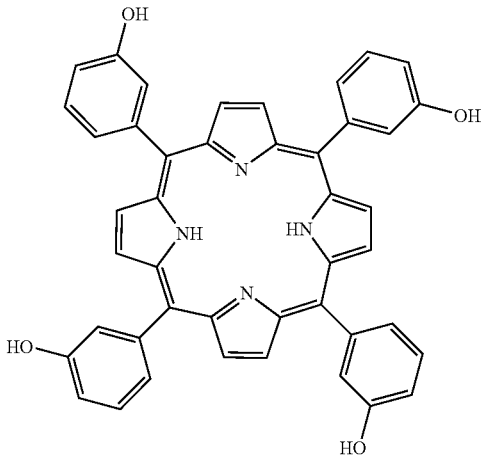
5, 10, 15, 20-Tetrakis(3-hydroxyphenyl)-21H, 23H-porphine
(7)
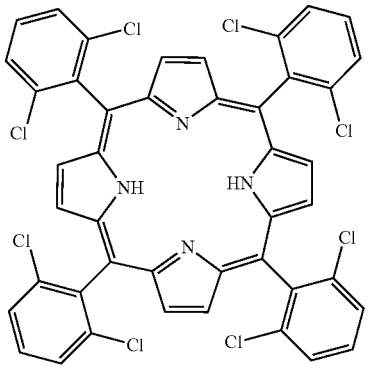
5, 10, 15, 20-Tetrakis(o-dichlorphenyl)-21H, 23H-porphine
(8)
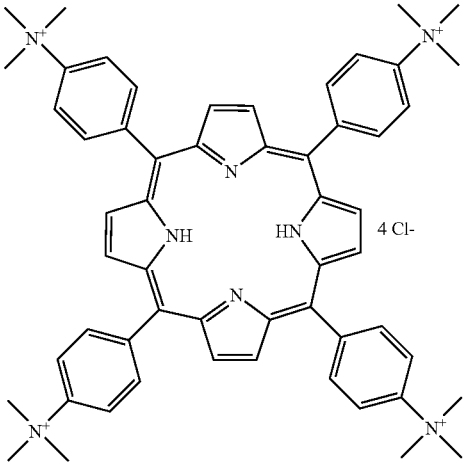
5, 10, 15, 20-Tetrakis(4-trimethylammoniophenyl) porphine tetrachloride
-continued
(9)
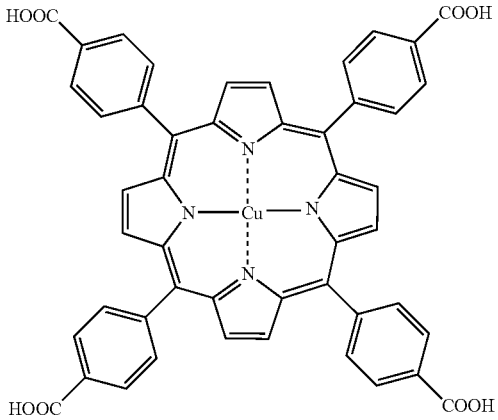
meso-Tetraphenylporphine-4, 4′, 4″, 4‴-tetracarboxylic acid, copper (II)
(10)
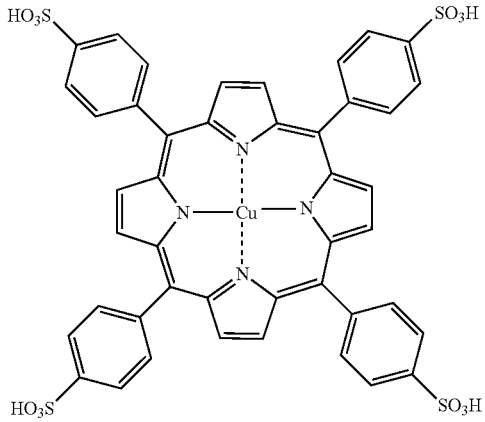
5, 10, 15, 20-Tetrakis(4-sulfonatophenyl)-21H, 23H-porphine copper (II)
(11)
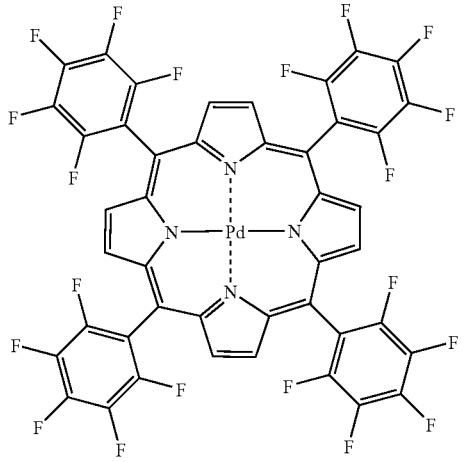
5, 10, 15, 20-Tetrakis(pentaflurophenyl)-21H, 23H-porphine palladium (II)

-continued (12)

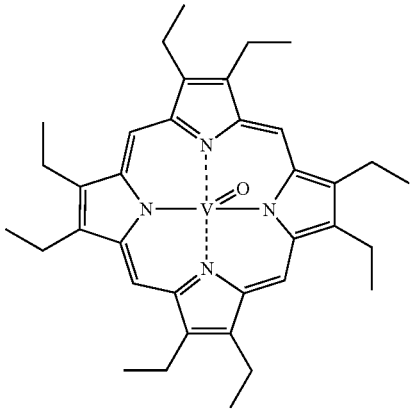

2, 3, 7, 8, 12, 13, 17, 18-Octaethyl-21H, 23H-porphine vanadium (IV) oxide

Additional examples of other porphine or porphine derivatives that can be used with embodiments disclosed herein include, but are not limited to, (13) 3,8,13,18-Tetramethyl-21H,23H-porphine-2,7,12,17-tetrapropionic acid dihydrochloride, (14) 8,13-Divinyl-3,7,12,17-tetramethyl-21H,23H-porphine-2,18-dipropionic acid cobalt(III) chloride, (15) 8,13-Bis(ethyl)-3,7,12,17-tetramethyl-21H,23H-porphine-2,18-dipropionic acid chromium(III) chloride, (16) 3,7,12,17-Tetramethyl-21H,23H-porphine-2,18-dipropionic acid dihydrochloride, (17)meso-Tetraphenylporphine-4,4',4",4'"-tetracarboxylic acid, iron (III) chloride, (18) 8,13-Bis(1-hydroxyethyl)-3,7,12,17-tetramethyl-21H,23H-porphine-2,18-dipropionic acid, (19) 5,10,15,20-Tetrakis(4-sulfonatophenyl)-21H,23H-porphine, manganese (III) chloride, (20) Pyropheophorbide-α-methyl ester, (21) 5,10,15,20-Tetraphenyl-21H,23H-porphine nickel(II), (22) N-Methyl Mesoporphyrin IX, (23) 8,13-Bis(vinyl)-3,7,12,17-tetramethyl-21H,23H-porphine-2,18-dipropionic acid, (24) 29H,31H-tetrabenzo porphine, (25) Uroporphyrin I dihydrochloride, (26) 8,13-Bis(vinyl)-3,7,12,17-tetramethyl-21H,23H-porphine-2,18-dipropionic acid zinc(II), (27) 5,10,15,20-Tetrakis(1-methyl-4-pyridinio) porphine tetra(p-toluenesulfonate), (28) 8,13-Bis(ethyl)-3,7,12,17-tetramethyl-21H,23H-porphine-2,18-dipropionic acid tin(IV) dichloride, and the like and the mixtures thereof. The chemical structures for agents (13-28) are shown below:

(13)

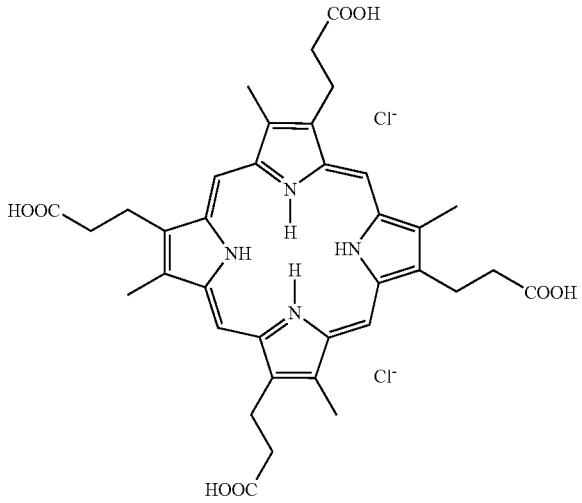

-continued (14)

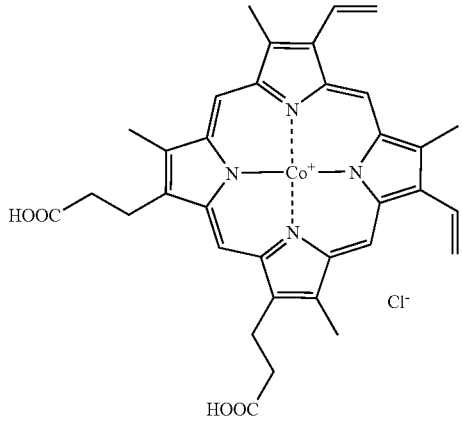

(15)

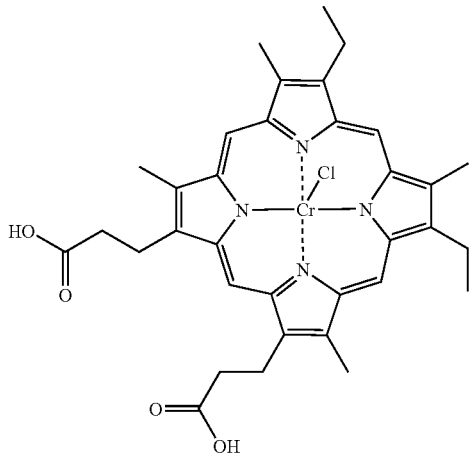

(16)

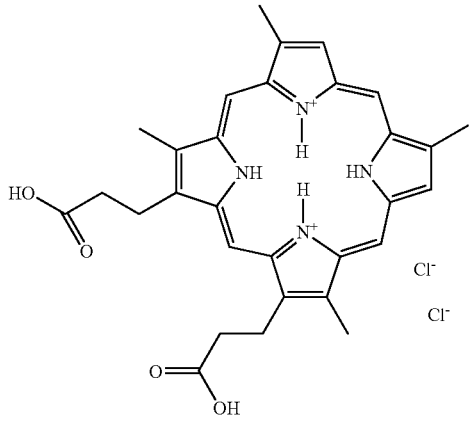

-continued
(17)
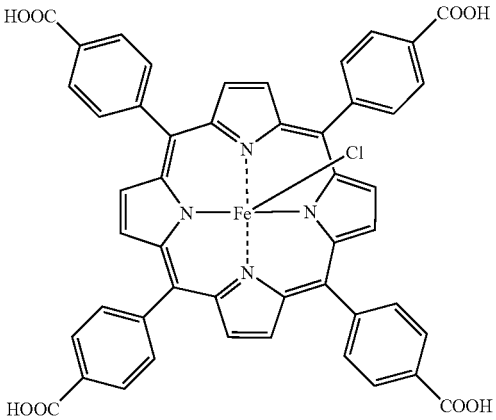
(18)
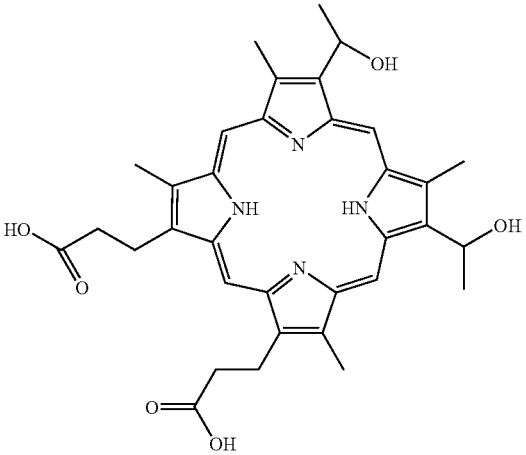
(19)
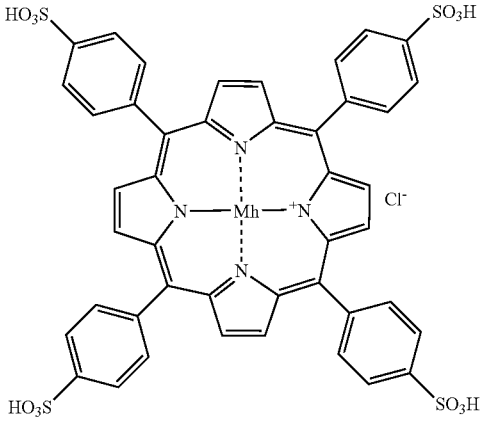
-continued
(20)
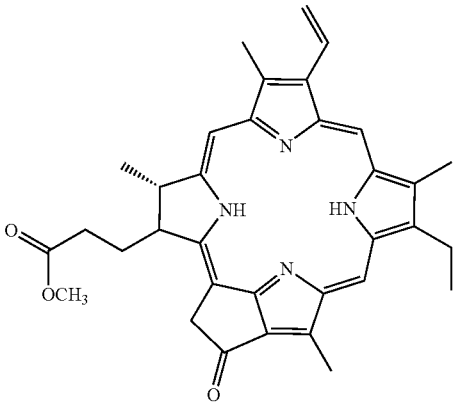
(21)
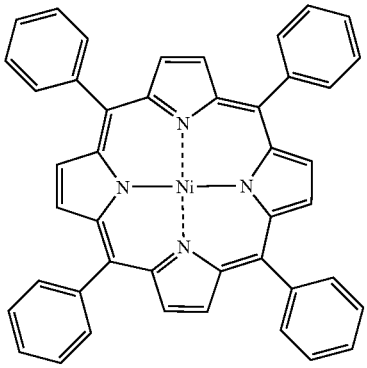
(22)
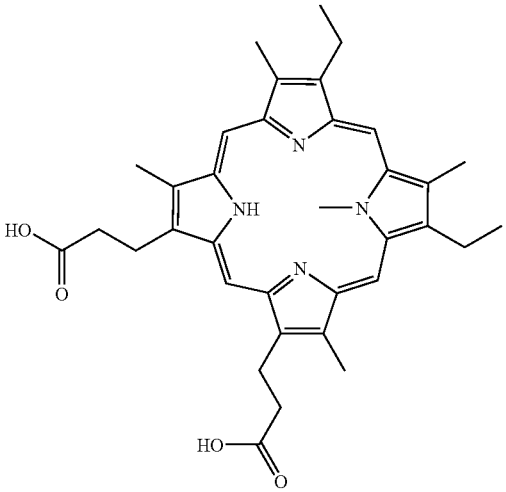

-continued (23)

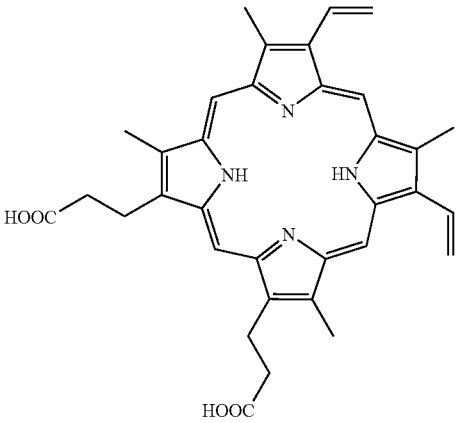

(24)

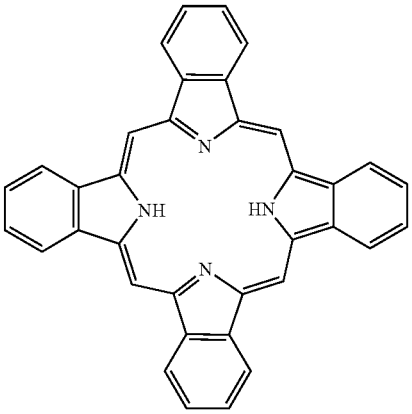

(25)

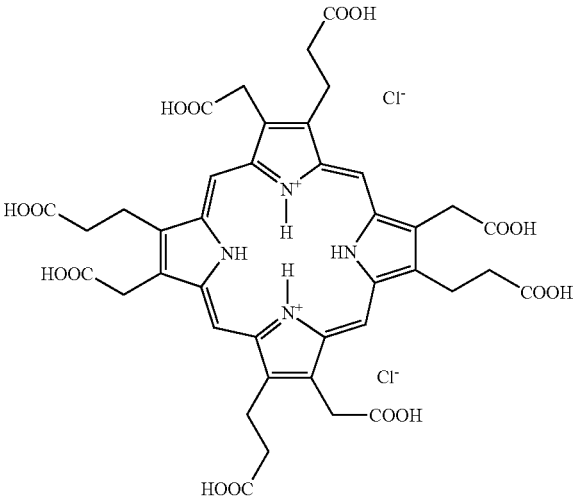

-continued (26)

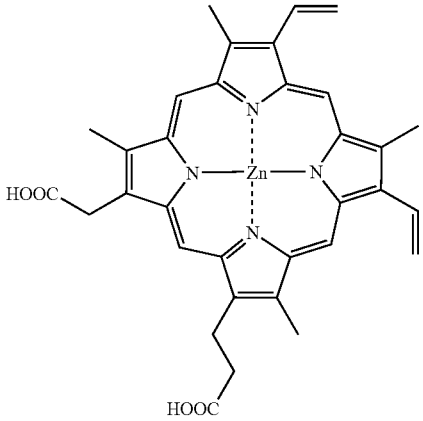

(27)

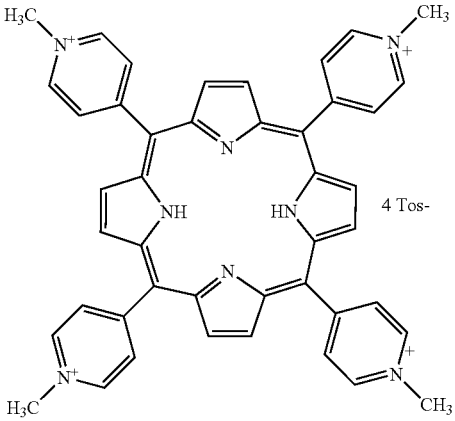

(28)

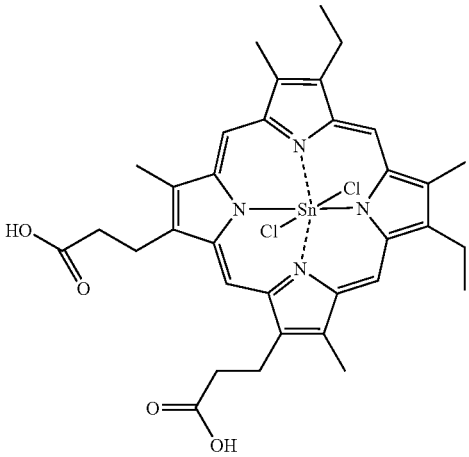

The porphine agent is generally present in the charge generating layer at a weight concentration of from about 0.1% to about 60%, including from about 1% to about 30%, and from about 4% to about 20%.

The additives for use in the charge generating layer can comprise a porphine moiety in their structure, and the porphine additive can be either metal-free or metal-containing, with metals such as Cu, Pd, V, Zn, Fe, Sn, Mn and the like. Both soluble and dispersible porphine derivatives may be used with exemplary embodiment.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. Nos. 3,121,006 and 4,439,507. Organic resinous polymers may be block, random or alternating copolymers. The photogenerating composition or pigment can be present in the resinous binder composition in various amounts. When using an electrically inactive or insulating resin, it is preferred that there be high levels of particle-to-particle contact between the photoconductive particle population. This condition can be achieved, for example, with the photoconductive material present, for example, in an amount of at least about 15 percent by volume of the binder layer with no limit on the maximum amount of photoconductor in the binder layer. If the matrix or binder comprises an active material, for example, poly-N-vinylcarbazole, the photoconductive material need only to comprise, for example, about 1 percent or less by volume of the binder layer with no limitation on the maximum amount of photoconductor in the binder layer. Generally for charge generator layers containing an electrically active matrix or binder such as poly-N-vinyl carbazole or phenoxy-poly(hydroxyether), from about 5 percent by volume to about 60 percent by volume of the photogenerating pigment is dispersed in about 40 percent by volume to about 95 percent by volume of binder, and particularly from about 7 percent to about 30 percent by volume of the photogenerating pigment is dispersed in from about 70 percent by volume to about 93 percent by volume of the binder. The specific proportions selected also depend to some extent on the thickness of the charge generating layer.

The thickness of the photogenerating or charge generating layer is not particularly critical. Layer thicknesses from about 0.05 micrometer to about 40.0 micrometers may be satisfactory. The photogenerating layer containing photoconductive compositions and/or pigments, and the resinous binder material ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, for example, 4,000 Angstroms to 8,000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. The charge transport layer in conjunction with the charge generating layer is a material which is an insulator to the extent that an electrostatic charge placed on the transport layer is not conductive in the absence of illumination, that is, does not discharge at a rate sufficient to prevent the formation and retention of an electrostatic latent image thereon.

Any polymer which forms a solid solution with the hole transport molecule (HTM) is a suitable polymer material for use in forming a hole transport layer in a photoreceptor device. Any solvent which dissolves both the polymer and the HTM is suitable for use in fabricating photoreceptor devices of the exemplary embodiment. Any suitable inactive resin binder soluble in methylene chloride or other suitable solvent may be employed. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The electrically inactive resin materials include polycarbonate resins having a molecular weight from about 20,000 to about 100,000, more particularly from about 50,000 to about 100,000. Particular materials for use as the electrically inactive resin material are poly(4,4'-dipropy-lidene-diphenylene carbonate) with a molecular weight of from about 35,000 to about 40,000, available as LEXAN 145™ from General Electric Company; poly(4,4'-isopropy-lidene-diphenylene carbonate) with a molecular weight of from about 40,000 to about 45,000, available as LEXAN 141 ™ from the General Electric Company; a polycarbonate resin having a molecular weight of from about 50,000 to about 100,000, available as MAKROLON™ from Farben-fabricken Bayer A. G., a polycarbonate resin having a molecular weight of from about 20,000 to about 50,000 available as MERLON™ from Mobay Chemical Company and poly(4,4'-diphenyl-11-cyclohexane carbonate). Methylene chloride solvent is an exemplary component of the charge transport layer coating mixture for adequate dissolving of all the components and for its low boiling point. However, the type of solvent selected depends on the specific resin binder utilized.

Any suitable and conventional technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the transport layer is from about 5 micrometers to about 100 micrometers, but thicknesses outside this range can also be used. In general, the ratio of the thickness of the charge transport layer to the charge generating layer is maintained from about 2:1 to 200:1 and in some instances as great as 400:1.

The photoreceptor of the exemplary embodiment may be used in any conventional electrophotographic imaging system such as copiers, duplicators, printers, facsimile and multifunctional systems. As described herein, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once.

The exemplary embodiment will further be illustrated in the following non limiting Example, it being understood that this Example is intended to be illustrative only and that the exemplary embodiment is not intended to be limited to the materials, conditions, process parameters, and the like, recited herein. Parts and percentages are by weight unless otherwise indicated.

EXAMPLE

Comparative Example I

A controlled charge generating layer dispersion was prepared as follows: 2.7 grams of chlorogallium phthalocyanine (ClGaPc) Type B pigment was mixed with 2.3 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 6 weight percent with the solvent mixture of xylene/n-butyl acetate (weight/weight ratio=2/1).

Example I

A charge generating layer dispersion was prepared as follows: 2.6 grams of chlorogallium phthalocyanine (ClGaPc) Type B pigment and 0.2 grams of meso-Tetraphenylporphine-4,4',4",4'"-tetracarboxylic acid (commercially available from Frontier Scientific, Inc., Logan, Utah) were mixed with 2.2 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 6 weight percent with the solvent mixture of xylene/n-butyl acetate (weight/weight ratio=2/1).

Example II

Another charge generating layer dispersion was prepared as follows: 2.5 grams of chlorogallium phthalocyanine (ClGaPc) Type B pigment and 0.5 grams of 8,13-Bis(vinyl)-3,7,12,17-tetramethyl-21H,23H-porphine-2,18-dipropionic acid zinc(II) (commercially available from Frontier Scientific, Inc., Logan, Utah) were mixed with 2.0 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 6 weight percent with the solvent mixture of xylene/n-butyl acetate (weight/weight ratio=2/1).

The Photoreceptor Devices

Three photoreceptor devices were prepared with the above charge generating layer dispersions, respectively. They were all coated on the same undercoat layer and then overcoated with the same charge transport layer. The undercoat layer is 3-component undercoat layer which was prepared as follows: Zirconium acetylacetonate tributoxide (about 35.5 parts), γ-aminopropyltriethoxysilane (about 4.8 parts) and poly(vinyl butyral) (about 2.5 parts) were dissolved in n-butanol (about 52.2 parts) to prepare a coating solution. The coating solution was coated via a ring coater, and the layer was pre-heated at about 59° C. for about 13 minutes, humidified at about 58° C. (dew point of 54° C.) for about 17 minutes, and then dried at about 135° C. for about 8 minutes. The thickness of the undercoat layer on each photoreceptor was approximately 1.3 μm. The ClGaPc charge generating layer dispersion was applied on top of the above undercoat layer, respectively. The thickness of the charge generating layer was approximately 0.2 μm. Subsequently, a 29 μm charge transport layer was coated on top of the charge generating layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxydiphenyl-1-1-cyclohexane, Mw=40,000)] available from Mitsubishi Gas Chemical Company, Ltd. (7.13 grams), and PTFE POLYFLON L-2 microparticle (1 gram) available from Daikin Industries dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Very similar photo-induced discharge curves (PIDC) were observed for all the photoreceptor devices, thus the incorporation of the porphine additive into charge generating layer does not adversely affect PIDC.

The above photoreceptor devices were then acclimated for 24 hours before testing in A-zone (85° F./80% Room Humidity). Print tests were performed in Copeland Work centre using black and white copy mode to achieve machine speed of 208 mm/s. Ghosting levels were measured against an empirical scale, where the smaller the ghosting grade level, the better the print quality. In general, a ghosting grade reduction of 1 to 2 levels was observed when the porphine additive was incorporated in charge generating layer. Therefore, incorporation of the porphine additive in charge generating layer significantly improves print quality such as ghosting.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising a charge generating layer, wherein the charge generating layer comprises a porphine additive selected from the group consisting of:

meso-Tetraphenylporphine-4,4',4",4'"-tetracarboxylic acid;
Phytochlorin;
5,10,15,20-Tetraphenyl -21H,23H-porphine;
5,10,15,20-Tetrakis(3-hydroxyphenyl)-21H,23H-porphine;
5,10,15,20-Tetrakis(o-dichlorophenyl)-21H,23H-porphine;
5,10,15,20-Tetrakis(4-trimethylammoniophenyl) porphine tetrachloride;
meso-Tetraphenylporphine-4,4',4",4" tetracarboxylic acid, copper(II);
5,10,15,20-Tetrakis(4-sulfonatophenyl)-21H,23H-porphine copper(II);
5,10,15,20-Tetrakis(pentafluorophenyl)-21H,23H-porphine palladium (II);
2,3,7,8,12,13,17,18-Octaethyl-21H,23H-porphine vanadium (IV) oxide;
3,8,13,18-Tetramethyl-21H,23H-porphine-2,7,12,17-tetrapropionic acid dihydrochloride;
8,13-Divinyl-3,7,12,17-tetramethyl-21H,23H-porphine-2,18-dipropionic acid cobalt(III) chloride;
8,13,-Bis(ethyl)-3,7,12,17-tetramethyl-21H,23H-porphine-2,18-dipropionic acid chromium(III) chloride;
3,7,12,17-Tetramethyl-21H,23H-porphine-2,18-dipropionic acid dihydrochloride;
meso-Tetraphenylporphine-4,4',4",4'"-tetracarboxylic acid, iron (III) chloride;
8,13-Bis(1-hydroxyethyl)-3,7,12,17-tetramethyl-21H, 23H-porphine-2,18-dipropionic acid;
5,10,15,20-Tetrakis(4-sulfonatophenyl)-21H,23H-porphine, manganese (III) chloride;
Pyropheophorbide-α-methyl ester;
5,10,15,20-Tetraphenyl-21H,23H-porphine nickel(II);
N-Methyl Mesoporphyrin IX;
8,13-Bis(vinyl)-3,7,12,17-tetramethyl-21H,23H-porphine-2,18-dipropionic acid;
Uroporphyrin I dihydrochloride;
8,13-Bis(vinyl)-3,7,12,17-tetramethyl-21H,23H-porphine-2,18-dipropionic acid zinc(II);
5,10,15,20-Tetrakis (1-methyl-4-pyridinio)porphine tetra (p-toluenesulfonate); and
8,13-Bis(ethyl)-3,7,12,17-tetramethyl-21H,23H-porphine-2,18-dipropionic acid tin(IV) dichloride.

2. The imaging member of claim 1, wherein the porphine additive is present in an amount of from about 0.1 percent to about 60 percent by weight of total solids in the charge generating layer.

3. The imaging member of claim 1, wherein the charge generating layer further comprises at least one photogenerating pigment and a binder.

4. The imaging member of claim 1, wherein the porphine additive is selected from the group consisting of:

(2) meso-Tetraphenylporphine-4,4',4",4'"-tetracarboxylic acid;
(4) 5,10,15,20-Tetraphenyl -21H,23H-porphine;
(6) 5,10,15,20-Tetrakis(3-hydroxyphenyl)-21H,23H-porphine;
(7) 5,10,15,20-Tetrakis(o-dichlorophenyl)-21H,23H-porphine;
(8) 5,10,15,20-Tetrakis(4-trimethylammoniophenyl)porphine tetrachloride;
(9) meso-Tetraphenylporphine-4,4',4",4" tetracarboxylic acid, copper(II);
(10) 5,10,15,20-Tetrakis(4-sulfonatophenyl)-21H,23H-porphine copper(II);
(11) 5,10,15,20-Tetrakis(pentafluorophenyl)-21H,23H-porphine palladium (II);
(17) meso-Tetraphenylporphine-4,4',4",4'"-tetracarboxylic acid, iron (III) chloride;
(19) 5,10,15,20-Tetrakis(4-sulfonatophenyl)-21H,23H-porphine, manganese (III) chloride;
(21) 5,10,15,20-Tetraphenyl-21H,23H-porphine nickel (II); and
(27) 5,10,15,20-Tetrakis (1-methyl-4-pyridinio)porphine tetra (p-toluenesulfonate).

5. The Imaging member of claim 1, wherein the porphine additive is selected from the group consisting of:

(3) Phytochlorin;
(12) 2,3,7,8,12,13,17,18-Octaethyl-21H,23H-porphine vanadium (IV) oxide;
(13) 3,8,13,18-Tetramethyl-21H,23H-porphine-2,7,12,17-tetrapropionic acid dihydrochloride;
(14) 8,13-Divinyl-3,7,12,17-tetramethyl-21H,23H-porphine-2,18-dipropionic acid cobalt(III) chloride;
(15) 8,13,-Bis(ethyl)-3,7,12,17-tetramethyl-21H,23H-porphine-2,18-dipropionic acid chromium(III) chloride;
(16) 3,7,12,17-Tetramethyl-21H,23H-porphine-2,18-dipropionic acid dihydrochloride;
(18) 8,13-Bis(1-hydroxyethyl)-3,7,12,17-tetramethyl-21H,23H-porphine-2,18-dipropionic acid;
(20) Pyropheophorbideα-methyl ester;
(22) N-Methyl Mesoporphyrin IX;
(23) 8,13-Bis(vinyl)-3,7,12,17-tetramethyl-21 H, 23H-porphine-2,18-dipropionic acid;
(25) Uroporphyrin I dihydrochloride;
(26) 8,13-Bis(vinyl)-3,7,12,17-tetramethyl-21H,23H-porphine-2,18-dipropionic acid zinc(II); and
(28) 8,13-Bis(ethyl)-3,7,12,17-tetramethyl-21H,23H-porphine-2,18-dipropionic acid tin(IV) dichloride.

6. The imaging member of claim 1, wherein the porphine additive is selected from the group consisting of:

(2) meso-Tetraphenylporphine-4,4',4",4'"-tetracarboxylic acid;
(3) Phytochlorin;
(4) 5,10,15,20-Tetraphenyl -21H,23H-porphine;
(6) 5,10,15,20-Tetrakis(3-hydroxyphenyl)-21H,23H-porphine;
(7) 5,10,15,20-Tetrakis(o-dichlorophenyl)-21H,23H-porphine;
(8) 5,10,15,20-Tetrakis(4-trimethylammoniophenyl)porphine tetrachloride;
(16) 3,7,12,17-Tetramethyl-21H,23H-porphine-2,18-dipropionic acid dihydrochloride;
(18) 8,13-Bis(1-hydroxyethyl)-3,7,12,17-tetramethyl-21H,23H-porphine-2,18-dipropionic acid;
(20) Pyropheophorbide-α-methyl ester;
(22) N-Methyl Mesoporphyrin IX;
(23) 8,13-Bis(vinyl)-3,7,12,17-tetramethyl-21H,23H-porphine-2,18-dipropionic acid; and
(27) 5,10,15,20-Tetrakis (1-methyl-4-pyridinio) porphine tetra (p-toluenesulfonate).

7. An imaging member comprising:

a substrate;
a charge generating layer disposed on the substrate; and
a charge transport layer disposed on the charge generating layer;
wherein the charge generating layer comprises a phthalocyanine and a porphine agent selected from the group consisting of:

(2) meso-Tetraphenylporphine-4,4',4",4'"-tetracarboxylic acid;
(3) Phytochlorin;
(4) 5,10,15,20-Tetraphenyl -21H,23H-porphine;
(6) 5,10,15,20-Tetrakis(3-hydroxyphenyl)-21H,23H-porphine;
(7) 5,10,15,20-Tetrakis(o-dichlorophenyl)-21H,23H-porphine;
(8) 5,10,15,20-Tetrakis(4-trimethylammoniophenyl) porphine tetrachloride;
(9) meso-Tetraphenylporphine-4,4',4",4" tetracarboxylic acid, copper(II);
(10) 5,10,15,20-Tetrakis(4-sulfonatophenyl)-21H,23H-porphine copper(II);
(11) 5,10,15,20-Tetrakis(pentafluorophenyl)-21H,23H-porphine palladium(II);
(12) 2,3,7,8,12,13,17,18-Octaethyl-21H,23H-porphine vanadium (IV) oxide;
(13) 3,8,13,18-Tetramethyl-21H,23H-porphine-2,7,12,17-tetrapropionic acid dihydrochloride;
(14) 8,13-Divinyl-3,7,12,17-tetramethyl-21H,23H-porphine-2,18-dipropionic acid cobalt(III) chloride;
(15) 8,13,-Bis(ethyl)-3,7,12,17-tetramethyl-21H,23H-porphine-2, 18-dipropionic acid chromium (III) chloride;
(16) 3,7,12,17-Tetramethyl-21H,23H-porphine-2,18-dipropionic acid dihydrochloride;
(17) meso-Tetraphenylporphine-4,4',4",4'"-tetracarboxylic acid, iron (III) chloride;
(18) 8,13-Bis(1-hydroxyethyl)-3,7,12,17-tetramethyl-21H,23H-porphine-2,18-dipropionic acid;
(19) 5,10,15,20-Tetrakis(4-sulfonatophenyl)-21H,23H-porphine, manganese (III) chloride;
(20) Pyropheophorbide-α-methyl ester;
(21) 5,10,15,20-Tetraphenyl-21H, 23H-porphine nickel (II);
(22) N-Methyl Mesoporphyrin IX;
(23) 8,13-Bis(vinyl)-3,7,12,17-tetramethyl-21H,23H-porphine-2,18-dipropionic acid;
(25) Uroporphyrin I dihydrochloride;
(26) 8,13-Bis(vinyl)-3,7,12,17-tetramethyl-21H,23H-porphine-2,18-dipropionic acid zinc(II);
(27) 5,10,15,20-Tetrakis (1-methyl-4-pyridinio)porphine tetra (p-toluenesulfonate); and
(28) 8,13-Bis(ethyl)-3,7,12,17-tetramethyl-21H,23H-porphine-2,18-dipropionic acid tin(IV) dichloride.

8. The imaging member of claim 7, wherein the charge generating layer further comprises at least one photogenerating pigment and binder.

9. The imaging member of claim 7, wherein the amount of the porphine agent in the charge generating layer is from about 0.1 weight % to about 60 weight %.

10. A method for reducing the potential for ghosting in an imaging member including a substrate, a charge transport layer, and a charge generating layer disposed between the substrate and the charge transport layer, the method comprising: incorporating a porphine agent into the charge generating layer, wherein the porphine agent is selected from the group consisting of:

(2) meso-Tetraphenylporphine-4,4',4",4'"-tetracarboxylic acid;
(3) Phytochlorin;
(4) 5,10,15,20-Tetraphenyl -21H,23H-porphine;
(6) 5,10,15,20-Tetrakis(3-hydroxyphenyl)-21H, 23H-porphine;
(7) 5,10,15,20-Tetrakis(o-dichlorophenyl)-21H,23H-porphine;
(8) 5,10,15,20-Tetrakis(4-trimethylammoniophenyl) porphine tetrachloride;
(9) meso-Tetraphenylporphine-4,4',4",4" tetracarboxylic acid, copper(II);
(10) 5,10,15,20-Tetrakis(4-sulfonatophenyl)-21H,23H-porphine copper(II);
(11) 5,10,15,20-Tetrakis(pentafluorophenyl)-21H,23H-porphine palladium(II);
(12) 2,3,7,8,12,13,17,18-Octaethyl-21H,23H-porphine vanadium (IV) oxide;
(13) 3,8,13,18-Tetramethyl-21H,23H-porphine-2,7,12,17-tetrapropionic acid dihydrochloride;
(14) 8,13-Divinyl-3,7,12,17-tetramethyl-21H,23H-porphine-2,18-dipropionic acid cobalt(III) chloride;
(15) 8,13,-Bis(ethyl)-3,7,12,17-tetramethyl-21H,23H-porphine-2,18-dipropionic acid chromium(III) chloride;
(16) 3,7,12,17-Tetramethyl-21H,23H-porphine-2,18-dipropionic acid dihydrochloride;
(17) meso-Tetraphenylporphine-4,4',4",4'"-tetracarboxylic acid, iron (III) chloride;
(18) 8,13-Bis(1-hydroxyethyl)-3,7,12,17-tetramethyl-21H,23H-porphine-2,18-dipropionic acid;
(19) 5,10,15,20-Tetrakis(4-sulfonatophenyl)-21H,23H-porphine, manganese (III) chloride;
(20) Pyropheophorbide-α-methyl ester;
(21) 5,10,15,20-Tetraphenyl-21H,23H-porphine nickel (II);
(22) N-Methyl Mesoporphyrin IX;
(23) 8,13-Bis(vinyl)-3,7,12,17-tetramethyl-21H,23H-porphine-2,18-dipropionic acid;
(25) Uroporphyrin I dihydrochloride;
(26) 8,13-Bis(vinyl)-3,7,12,17-tetramethyl-21H,23H-porphine-2,18-dipropionic acid zinc(II);
(27) 5,10,15,20-Tetrakis (1-methyl-4-pyridinio)porphine tetra (p-toluenesulfonate); and
(28) 8,13-Bis(ethyl)-3,7,12,17-tetramethyl-21H,23H-porphine-2,18-dipropionic acid tin(IV) dichloride.

11. The method of claim 10, wherein the porphine agent in the charge generating layer is incorporated at a concentration of from about 0.1 weight % to about 60 weight %.

12. The method of claim 10, wherein the porphine agent in the charge generating layer is incorporated at a concentration of from about 1.0 weight % to about 30 weight %.

13. An image forming apparatus for forming images on a recording medium comprising:

a) an electrophotographic imaging member having a charge retentive-surface to receive an electrostatic latent image thereon, wherein the electrophotographic imaging member comprises a substrate, a charge generating layer formed on the substrate, wherein the charge generating layer comprises a porphine additive, and a charge transport layer formed on the charge generating layer;
b) development component to apply a developer material to the charge-retentive surface to develop the electrostatic latent image to form a developed image on the charge-retentive surface;
c) a transfer component for transferring the developed image from the charge-retentive surface to another member or a copy substrate; and
d) a fusing member to fuse the developed image to the copy substrate;

wherein the porphine additive is selected from the group consisting of:

(2) meso-Tetraphenylporphine-4,4',4",4'"-tetracarboxylic acid;
(3) Phytochlorin;

(4) 5,10,15,20-Tetraphenyl -21H,23H-porphine;

(6) 5,10,15,20-Tetrakis(3-hydroxyphenyl)-21H,23H-porphine;

(7) 5,10,15,20-Tetrakis(o-dichlorophenyl)-21H,23H-porphine;

(8) 5,10,15,20-Tetrakis(4-trimethylammoniophenyl)porphine tetrachloride;

(9) meso-Tetraphenylporphine-4,4',4",4" tetracarboxylic acid, copper(II);

(10) 5,10,15,20-Tetrakis(4-sulfonatophenyl)-21H,23H-porphine copper(II);

(11) 5,10,15,20-Tetrakis(pentafluorophenyl)-21H,23H-porphine palladium(II);

(12) 2,3,7,8,12,13,17,18-Octaethyl-21H,23H-porphine vanadium (IV) oxide;

(13) 3,8,13,18-Tetramethyl-21H,23H-porphine-2,7,12,17-tetrapropionic acid dihydrochloride;

(14) 8,13-Divinyl-3,7,12,17-tetramethyl-21H,23H-porphine-2,18-dipropionic acid cobalt (III) chloride;

(15) 8,13,-Bis(ethyl)-3,7,1 2,17-tetramethyl-21H,23H-porphine-2,18-dipropionic acid chromium(III) chloride;

(16) 3,7,12,17-Tetramethyl-21H,23H-porphine-2,18-dipropionic acid dihydrochloride;

(17) meso-Tetraphenylporphine-4,4',4",4'"-tetracarboxylic acid, iron (III) chloride;

(18) 8,13-Bis(1-hydroxyethyl)-3,7,12,17-tetramethyl-21H, 23H-porphine-2,18-dipropionic acid;

(19) 5,10,15,20-Tetrakis(4-sulfonatophenyl)-21H,23H-porphine, manganese (III) chloride;

(20) Pyropheophorbide-α-methyl ester;

(21) 5,10,15,20-Tetraphenyl-21H,23H-porphine nickel (II);

(22) N-Methyl Mesoporphyrin IX;

(23) 8,13-Bis(vinyl)-3,7,12,17-tetramethyl-21H,23H-porphine-2,18-dipropionic acid;

(25) Uroporphyrin I dihydrochloride;

(26) 8,13-Bis(vinyl)-3,7,12,17-tetramethyl-21H,23H-porphine-2,18-dipropionic acid zinc(II);

(27) 5,10,15,20-Tetrakis (1-methyl-4-pyridinio) porphine tetra (p-toluenesulfonate); and

(28) 8,13-Bis(ethyl)-3,7,12,17-tetramethyl-21H,23H-porphine-2,18-dipropionic acid tin(IV) dichloride.

* * * * *